United States Patent [19]

Caldwell et al.

[11] Patent Number: 4,752,369

[45] Date of Patent: Jun. 21, 1988

[54] ELECTROCHEMICAL CELL WITH IMPROVED ENERGY EFFICIENCY

[75] Inventors: Donald L. Caldwell; Kenneth A. Poush, both of Lake Jackson, Tex.

[73] Assignee: The Dow Chemical Company, Midland, Mich.

[21] Appl. No.: 668,063

[22] Filed: Nov. 5, 1984

[51] Int. Cl.[4] ..... C25B 1/16

[52] U.S. Cl. ..... 204/252; 204/98; 204/128; 204/266; 204/283; 204/295; 204/296

[58] Field of Search ..... 204/98, 128, 263–266, 204/296, 252, 295, 283

[56] References Cited

U.S. PATENT DOCUMENTS

| | | | |
|---|---|---|---|
| 3,438,879 | 4/1969 | Kircher et al. | 204/95 |
| 4,105,514 | 8/1978 | Justice et al. | 204/98 |
| 4,112,149 | 9/1978 | Babinsky | 204/296 |
| 4,135,996 | 1/1979 | Bouy et al. | 204/98 |
| 4,289,601 | 9/1981 | Kadija | 204/296 |
| 4,411,749 | 10/1983 | Sato et al. | 204/98 |
| 4,426,272 | 1/1984 | Hanmer | 204/296 |

FOREIGN PATENT DOCUMENTS

| | | | |
|---|---|---|---|
| 0011199 | 2/1978 | Japan | 204/98 |
| 0075174 | 7/1978 | Japan | 204/98 |
| 0112487 | 9/1981 | Japan | 204/98 |

*Primary Examiner*—John F. Niebling
*Assistant Examiner*—Kathryn Rubino
*Attorney, Agent, or Firm*—Andrew E. Pierce

[57] ABSTRACT

An electrochemical cell having a hydraulically impermeable permselective membrane is operated more efficiently by (1) separating the anode and the cathode of such a cell from the permselective membrane by a spacing means which is porous, hydrophilic, and electrically non-conductive, or alternatively, (2) providing a coating on the metal electrodes of said cell which is hydrophilic, porous, and electrically non-conductive. Said spacing means is of a material selected from the group consisting of at least one of mineral fibers, synthetic organic polymers, and ceramics and glasses.

15 Claims, No Drawings

ELECTROCHEMICAL CELL WITH IMPROVED ENERGY EFFICIENCY

BACKGROUND OF THE INVENTION

1. Field of the Invention

This invention relates to electrochemical cells such as electrolytic cells having close-spaced, or "zero-gap", clearance between the permselective membrane and the electrodes.

2. Description of the Prior Art

In electrochemical cells having permselective membranes, particularly in electrolytic cells for the production of an alkali metal hydroxide and halogen, high concentrations of alkakli metal hydroxides are obtainable. Production of such concentrated solutions of an alkali metal hydroxide require high cell voltages and thus result in increased power costs from operating the electrolytic cells.

One solution to the problem of reducing the cost of power for operating electrolytic cells has been to decrease the clearance between the permselective membrane and the electrodes in order to decrease the ohmic losses through the electrolytes. When this spacing has been reduced almost to zero in close-spaced, or "zero-gap", electrolytic cells, it has been found that the release of hydrogen and halogen bubbles is impeded, especially the release of hydrogen gas at the cathode, as the bubbles of hydrogen are retained in the cathode-permselective membrane gap area. The presence of hydrogen bubbles in the gap area raises the cell voltage requirement and thus reduces the energy efficiency of the cell.

One prior art solution to the problem of increased cell voltage requirements under these conditions is the placing of the permselective membrane on the cathode of the electrolytic cell. When this is done, little or no space remains between the permselective membrane and the cathode. It has been found that this arrangement also impedes the release of hydrogen bubbles which are formed at the cathode and therefore raises the cell voltage requirement. It has therefore been found to be more desirable to provide a space between the cathode and the permselective membrane which is sufficient to permit the release of hydrogen gas bubbles. At the anode, halogen is released so that generally a sufficient space is necessary between the anode and the permselective membrane in order to avoid raising the cell voltage requirements.

In U.S. Pat. No. 4,105,514, a spacing means is disclosed which is placed between the anode and the permselective membrane of a wide gap electrolytic cell. The space between the cathodes and the permselective membrane is equal to or greater than the space between the anode and the permselective membrane and is free of a spacing means in order to provide maximum release of hydrogen gas at the membrane-cathode gap. In this patent, the spacing means is disclosed as a screen, or net, composed of any non-conducting chlorine-resistant material, such as a glass fiber, asbestos filaments, or a plastic material such as polyvinylidene chloride. Utilizing this spacing means between only the anode and the permselective membrane of the electrolytic cell allows an increase in the usual cathode-permselective membrane gap with a decrease in the cell voltage since "gas blinding" at the electrodes is avoided. The use of a spacing means in combination with a low to moderate differential pressure between the cathode compartment and the anode compartment of the cell results in increased energy efficiency.

In U.S. Pat. No. 4,135,996 there is disclosed a composite ion exchange membrane, including a cation-exchange membrane, having joined to it a microporous layer which is preferably at least as thick as the cation exchange membrane itself. When used in electrolysis of an alkali metal brine to produce chlorine and sodium hydroxide, these products are obtained with a high Faradaic yield. The microporous layer can be composed of asbestos or polytetrafluoroethylene.

In U.S. Pat. No. 3,438,879, there is disclosed a low energy efficiency, wide gap electrolytic cell having a chemically resistant, porous, protective barrier between the anode and one of the permselective membranes of the cell. This protective barrier can be composed of asbestos, glass fibers, or a synthetic polymer such as polyethyelene and polyvinylidene chloride. This protective barrier is said to extend the life of the permselective membrane.

SUMMARY OF THE INVENTION

The energy efficiency of an electrochemical cell, particularly a close gap electrolysis cell for the production of halogen and an alkali metal hydroxide, can be improved by separating a hydraulically impermeable permselective membrane from at least one of the anode and cathode of said cell with a spacing means which is characterized as hydrophilic, electrically non-conductive, and porous. The spacing means is composed of at least one of a mineral fiber, a synthetic organic polymer, or a ceramic or glass. Use of a spacing means having a thickness of up to about 0.1 of an inch, preferably about 0.001 of an inch to about 0.1 of an inch permits the maintenance of a minimum, uniform gap between the permselective membrane and the electrodes without gas blinding of the membrane, thus decreasing the energy requirements of the electrolytic cell. Alternatively, the cell electrodes can be coated with the composition of said spacing means to a thickness equal to that of said spacing means. This reduction in gap between the electrodes and the permselective membrane unexpectedly does not result in adherence of hydrogen gas on the cathode side of the membrane or halogen gas on the anode side of the membrane during the electrolysis process so as to reduce the energy efficiency of the cell.

DETAILED DESCRIPTION OF THE INVENTION

A spacing means is disclosed for use in an electrochemical cell to increase the energy efficiency of the cell. An electrochemical cell is defined in this specification and claims as including (1) electrolytic cells, particularly those for the electrolysis of an alkali metal halide, and (2) fuel cells such as those cells used for the direct production of electrical current from a fuel and oxidant which employ an oxidizing electrode, a fuel electrode, and a liquid electrolyte, particularly an aqueous electrolyte. For convenience, the invention will be disclosed in connection with an electrolytic cell. One skilled in this art would be able to use the disclosed spacing means in a fuel cell without further exemplification.

An electrolytic cell is disclosed in accordance with the invention, which comprises an hydraulically impermeable permselective ion exchange membrane, an anode and anolyte compartment containing an alkali metal halide such as sodium chloride, a cathode and a catholyte compartment containing an alkali metal hydroxide such as sodium hydroxide, and an independent and distinct spacing means between said permselective membrane and both said anode and said cathode or, alternatively, a spacing means only between said cathode and said permselective membrane, or, alternatively, a spacing means only between said anode and said permselective membrane. In addition, an electrolytic cell is disclosed having a permselective membrane, an anode in an anolyte compartment, and a cathode in a catholyte compartment, wherein either or both anode and cathode form a unitary electrode coated with hydrophilic, electrically non-conductive, and porous material. This coating functions as a spacing means so as to provide a uniform spacing between the permselective membrane and the electrodes of the cell. Both the independent and distinct spacing means and the coating material on the electrodes of the cell are of a material consisting of at least one of mineral fibers, synthetic organic polymers, and ceramics and glasses. Whether the spacing means is utilized as an independent and distinct membrane, or as a coating on the electrodes of the cell, the spacing means or electrode coating provides a means of avoiding the "gas blinding" and consequent higher energy usage in an electrolytic cell having a close gap between the electrodes and the permselective membrane. Such electrolytic cells are sometimes referred to as "zero-gap" electrolytic cells.

The permselective membrane of the cell of the instant invention can be a cation-exchange membrane which is particularly suitable for electrolysis of alkali metal halide brines to produce alkali metal hydroxides and a halogen. The electrolysis cell can be adapted for other purposes by using an anion-exchange membrane in place of the cation-exchange membrane. Examples of cation-exchange membrane are those formed from organic resins, for instance, phenol-formaldehyde resins or resins obtained by polymerization of styrene and/or divinylbenzene, fluorocarbon resins, polysulphones, or polymethacrylic or phenoxy resins, with cation-exchanging radicals such as $—SO_3H$, —COOH, $—PO_2H_2$, $—PO_3H_2$. Such resins also can be employed as mixed polymers or copolymers, for example, fluorocarbon resins can contain substituted or unsubstituted alkoxy groups and contain elements such as sulphur, nitrogen, and oxygen. Generally, resins with sulphonic groups are preferred, and among these polyfluorocarbon resins which contain cation exchange groups and are copolymers of tetrafluoroethylene with $CF_2{=}CF—OCF_2CF_2SO_3H$, or other corresponding acidic polymerizable fluorocarbon. Preferably, the polyfluorocarbon is at least one of a polymer of perfluorosulphonic acid, a polymer of perfluorocarboxylic acid, and copolymers thereof. These copolymers have equivalent weights of about 900 to about 1800. These types of materials are characterized by long fluorocarbon chains with various acidic groups including sulphonic, phosphonic, sulphonamide, or carboxylic groups or alkali metal salts of said groups attached thereto.

The cathodes used in the electrolytic cells of the invention preferably are forminous metal structures comprising steel, nickel, or copper, or these metals in combination with other metals such as titanium which are suitably coated with a material which provides a low hydrogen overvoltage. The cathodes are preferably fabricated to facilitate the release of hydrogen gas from the catholyte liquor. It is therefore preferable that the cathodes have an open area of at least about 10%, preferably an open area of from about 30% to about 70%, and more preferably an open area of from about 45% to about 65% of the volume of the cathode.

The cathodes suitable for use in the electrochemical cells of the invention also can be bi-porous electrodes comprising a porous metal layer in contact with an electrochemically active catalytic layer comprising a hydrophobic polymer material, as disclosed in U.S. Pat. No. 3,438,815, incorporated herein by reference, or gas (air or oxygen) diffusion electrodes, as disclosed in U.S. Pat. No. 3,594,236, incorporated herein by reference.

Examples of suitable metal cathodes include foraminous metal cathodes, for instance, perforated metal plate, sheet, mesh, or screen, as well as expanded metal cathodes. When a perforated sheet or plate is employed as the cathode, the gap between the cathode and the membrane which is occupied by the spacing means disclosed herein can be, generally up to about 0.1 of an inch, preferably about 0.001 of an inch to about 0.1, and most preferably about 0.05 of an inch to about 0.1 of an inch. When the foraminous metal cathode is coated with the same hydrophilic, electrically non-conductive, porous material which serves as a spacing means in electrolytic cells having uncoated electrodes, the coating on the electrodes is the same as the thickness of the independent spacing means disclosed above. The electrolytic cells of the invention have a gap between electrodes and the permselective membrane of the cell which is at least equal to the thickness of the spacing means or, alternatively, at least equal to the coating on the metal electrodes. Only the side of the cathode facing the permselective membrane need be coated. It is unexpected that the spacing means or the coating on the electrodes described above is effective in preventing gas blinding of the electrodes and of the permselective membrane, particularly gas blinding of the surfaces of said membrane and said cathode which face each other.

The anodes used in the electrolytic cells of the invention preferably have a foraminous metal structure, at least a portion of which is covered with an electrocatalytically active material. Suitable anodes are composed of valve metals such as titanium or tantalum, or metals such as steel, copper, or aluminum clad with a valve metal. Over at least a part of the surface of the valve metal is a thin coating of an electrocatalytically active material such as a platinum group metal, a platinum group metal oxide, an alloy of a platinum group metal, or a mixture thereof. The term "platinum group" as used in this specification and claims means an element of the group consisting of ruthenium, rhodium, palladium, osmium, iridium, and platinum. The anodes also can be bi-porous electrodes or gas diffusion (air or oxygen) electrodes.

The preferred foraminous metal anode can be a perforated plate or sheet, mesh or screen, or an expanded metal. On the planar surface of the anodes suitably sized openings permit the flow of fluids through the anode surface. The foraminous metal anodes have a thickness of from about 0.03 of an inch to about 0.1 of an inch and preferably from about 0.05 of an inch to about 0.08 of an inch. For example, a suitable anode can be prepared utilizing two foraminous screens which are spaced apart to provide for the passage of a halogen gas and anolyte, and two enclosed conductive supports which supply electrical current. The screens can be closed at the top, bottom and front edges to form a self-contained compartment. The foraminous metal anodes can be attached to anode plates by means of conductive supports such as rods which supply electrical energy to the electrochemically active surface. The anode plate is wholly or partially constructed of electroconductive materials such as steel, copper, aluminum, titanium, or a combination of these materials. Where the electroconductive material can be attacked by the alkali metal halide brine or halogen gas, it is suitably covered with a chemically inert material. Where the hydrophilic, electrically nonconductive, porous spacing means utilized in the electrolytic cells of the invention is formed upon the anode, a coating of about 0.001 to about 0.1 of an inch, and most preferably about 0.05 to about 0.1 of an inch is utilized.

Materials suitable for use as independent spacing means in the electrolytic cells of the invention or, alternatively, as coating materials for the electrodes of the electrolytic cells of the invention include at least one of (1) a mineral fiber such as asbestos, vermiculite, mica, zeolite, silicate gels, phosphate gels, fibrous titanium dioxide, fibrous zirconium oxide or at least one of (2) a synthetic organic polymer such as polyvinylidene fluoride, polyvinylchloride, an epoxy resin, a vinyl ester resin such as polyvinyl acetate, and a fluorocarbon polymer resin such as polytetrafluoroethylene. The independent spacing means or the coating for the electrodes of the electrolytic cells of the invention must be hydrophilic. Some of the polymer categories listed above may not designate polymers having suitable hydrophilicity without special treatment to render the polymer hydrophilic. Specifically, the use of fluorocarbon polymers such as polymers of tetrafluoroethylene, polymers of fluorinated ethylene propylene, and copolymers thereof as spacing means in the electrolytic cells of the invention results in lower energy efficiency of the electrolytic cell because of gas blinding unless the fluorocarbon polymer is previously treated to render it hydrophilic.

The spacing means can be a separate sheet of one of the above materials formed by conventional means from an aqueous slurry of at least one of mineral fibers, synthetic organic polymers, ceramic fibers or glass fibers. Preferably the sheets of spacing means are formed of asbestos. Coating the metal electrodes can be accomplished by conventional means utilized to form a diaphragm of asbestos on a metal electrode of an electrolytic cell. Thus an aqueous slurry of the component selected, for instance, asbestos, is prepared and using a partial vacuum, deposited upon one side of a foraminous electrode.

In a preferred embodiment, the independent and distinct spacing means disclosed is utilized in an electrolytic cell, both between the cathode and the permselective membrane and the anode and the permselective membrane. In a less preferred embodiment, said spacing means is utilized only between the cathode and the permselective membrane of the electrolytic cell. In a less preferred embodiment, said spacing means is utilized only between the anode and the permselective membrane of the electrolytic cell.

The following examples illustrate the various aspects of the invention but are not intended to limit its scope. Where not otherwise specified throughout this specification and claims, temperatures are given in degrees centigrade, and parts, percentages, and proportions are by weight.

EXAMPLE 1

An asbestos mat spacing means was made by mixing one liter of an alkaline brine containing five grams per liter of sodium chloride, and five grams per liter of chrysotile asbestos. The mixture was filtered utilizing a vacuum funnel. Thereafter about five cubic centimeters of an aqueous solution of sodium silicate containing twenty five grams per liter of sodium silicate was spread over the filter pad at the end of the filtering procedure. The filtrate on the pad was dried at 100° C. for two hours and further dried at 200° C. for four more hours. The asbestos mat weight was 0.045 g per square inch and mat thickness was about 0.01 inch.

The asbestos mat was placed in a miniature chlor-alkali cell having a cation exchange permselective membrane which is a microporous laminate of a homogenous, 1 mil film of 1500 equivalent weight and a 5 mil film of 1100 equivalent weight of a hydrolyzed copolymer of tetrafluoroethylene and a sulphonated perfluorovinyl ether sold under the trademark NAFION 324. The asbestos mat prepared above was placed between the cathode and the permselective cation exchange membrane of the cell. A titanium anode was utilized and adjusted so as to touch the opposite side of the permselective membrane. The cell was operated at one amp per square inch at 80° C. with a concentration of 12% by weight sodium hydroxide over a period of ten days. The cell voltage was found to be 0.2 volts lower than a similarly operated cell which was operated without the asbestos mat, as shown in control Example 2 below.

EXAMPLE 2

(control, forming no part of this invention)

The electrolytic cell described in Example 1 was operated without the asbestos mat as a control. The cell was operated at one amp per square inch at 80° C. with 12% by weight sodium hydroxide concentration for a period of ten days. The cell voltage was less stable than that of the cell described in Example 1, and 0.2 volts higher than the voltage of the electrolytic cell of Example 1. Overall, the control cell required an increase of about 140 kilowatt hours per metric ton of caustic for operation, as compared to the cell of Example 1.

EXAMPLE 3

A small chlor-alkali electrolytic cell was constructed of a rectangular Plexiglas plate and a titanium plate by placing the Plexiglas plate in a vise in combination with a woven wire cathode of about 50% open area. An asbestos mat, prepared as shown in Example 1, was placed over the woven wire cathode. A permselective cation exchange membrane similar to that used in the electrolytic cell of Example 1 was placed between the titanium plate anode and the woven wire mesh cathode with the cathode being separated from the permselective membrane by the asbestos mat. The two halves of the cell were bolted together utilizing an asbestos gasket on either side of the permselective membrane which is held between the two halves of the electrolytic cell which define the electrolytic cell cavity. The electrolytic cell was bolted to a lab rack and fitted with fluid ports and filled with saturated sodium chloride brine on the anolyte side of the permselective membrane and 40 g per liter sodium hydroxide on the catholyte side of the permselective membrane. The cell was operated utilizing a direct current power source with a current of 9 amps. A quartz heater and a temperature control system was set to control the cell at a temperature of 80° C. measured in the catholyte chamber. The brine flow to the anolyte chamber and the water flow to the catholyte chamber of the cell were each adjusted to maintain the anolyte at about 170 g per liter of sodium chloride and the catholyte at about 12% by weight sodium hydroxide concentration.

The cell was operated at 2,393 kilowatt hours per metric ton of sodium hydroxide at a current usage of 1 amp per square inch. After 17 days of operation, the current was raised to two amps per square inch and the power consumption was found to be 2600 kilowatt hours per metric ton of sodium hydroxide. At this operating current the production rate of sodium hydroxide doubled as compared to the earlier operating current of 1 amp per square inch.

While this invention has been described with reference to certain specific embodiments, it will be recognized by those skilled in the art that many variations are possible without departing from the scope and spirit of the invention. It will be understood that it is intended to cover all changes and modifications of the invention disclosed herein for the purposes of illustration which do not constitute departures from the spirit and scope of the invention.

The embodiments of the invention in which an exclusive property or privilege is claimed are defined as follows:

1. A close gap electrochemical cell having an hydraulically impermeable permselective membrane dividing an anode from a cathode contained respectively in anolyte and catholyte compartments, said cell having a permselective membrane/cathode gap of about 0.001 to about 0.1 inch thickness maintained by independent and distinct spacing means of said thickness, said spacing means comprising a material selected from at least one of the groups consisting of mineral fibers, synthetic organic polymers, and ceramics and glasses, wherein said spacing means is characterized as hydrophilic, electrically nonconductive, and porous and wherein said cell is characterized as having increased energy efficiency as the result of the avoidance of gas blinding at the cathode/membrane gap.

2. The electrochemical cell of claim 1 wherein said spacing means comprises (1) a mineral fiber selected from at least one of the group consisting of asbestos, vermiculite, mica, zeolite, silicate gels, phosphate gels, fibrous titanium dioxide, fibrous zirconium oxide, and mixtures thereof or (2) a synthetic organic polymer selected from at least one of the group consisting of polyvinyl chloride, polyvinylidene fluoride, an epoxy resin, a vinyl ester resin, and a fluorocarbon polymer or mixtures of (1) and (2).

3. The electrochemical cell of claim 2 wherein said spacing means comprises asbestos.

4. The electrochemical cell of claim 2, wherein said cell is an electrolytic cell, said anolyte compartment contains an aqueous solution of an alkali metal halide and said catholyte compartment contains an aqueous solution of an alkali metal hydroxide.

5. The electrolytic cell of claim 4, wherein said cathode is a foraminous metal in the form of a perforated plate or sheet, a mesh, screen, or expanded metal, said alkali metal halide is an alkali metal chloride.

6. The electrolytic cell of claim 5, wherein said hydraulically impermeable permselective membrane comprises at least one of a fluorocarbon polymer or copolymer selected from the group consisting of a polymer of perfluorosulphonic acid, a polymer of perfluorocarboxylic acid, and copolymers thereof.

7. The electrolytic cell of claim 6 wherein said anolyte compartment contains an aqueous solution of an alkali metal chloride.

8. The electrolytic cell of claim 7 wherein said alkali metal chloride is sodium chloride and said alkali metal hydroxide is sodium hydroxide.

9. In a process for the electrolysis of an aqueous solution of an alkali metal halide in a close gap electrolytic cell having an anode and a cathode contained respectively in an anolyte and a catholyte compartment and separated by a hydraulically impermeable permselective membrane, the improvement wherein increased energy efficiency is obtained in said cell by electrolyzing said solution of an alkali metal halide so as to avoid gas blinding of said permselective membrane in the gap between said permselective membrane and said cathode by maintaining said gap at about 0.001 to about 0.1 inch thickness by independent and distinct spacing means characterized as hydrophilic, electrically nonconductive, and porous, said spacing means comprising a material selected from at least one of the group consisting of mineral fibers, synthetic organic polymers, and ceramics and glasses.

10. The process of claim 9 wherein at least one of said anode and cathode is foraminous, said spacing means is composed of at least one of (1) a mineral fiber selected from the group consisting of asbestos, vermiculite, mica, zeolite, silicate gels, phosphate gels, fibrous titanium dioxide, fibrous zirconium oxide or at least one of (2) a synthetic organic polymer selected from at least one of the group consisting of polyvinyl chloride, polyvinylidene fluoride, an epoxy resin, a vinyl ester resin, and a fluoroocarbon polymer or mixtures of (1) and (2).

11. The process of claim 10 wherein said spacing means comprises asbestos.

12. The process of claim 10 wherein said anolyte compartment contains an aqueous solution of an alkali metal chloride and said catholyte compartment contains an aqueous solution of an alkali metal hydroxide.

13. The process of claim 12 wherein said cathode is a foraminous metal and in the form of a perforated plate or sheet, a mesh, screen, or expanded metal and wherein said alkali metal chloride is sodium chloride and said alkali metal hydroxide is sodium hydroxide.

14. The process of claim 13 wherein said hydraulically impermeable, permselective membrane comprises a fluorocarbon polymer or copolymer or mixtures thereof selected from at least one of the group consisting of a polymer of perfluorosulphonic acid, a polymer of perfluorocarboxylic acid, and copolymers thereof.

15. The process of claim 14 wherein said alkali metal chloride is sodium chloride and said alkali metal hydroxide is sodium hydroxide.

* * * * *